US008149138B1

(12) United States Patent
Burke et al.

(10) Patent No.: US 8,149,138 B1
(45) Date of Patent: Apr. 3, 2012

(54) BARRIER GATE

(75) Inventors: Thomas J. Burke, Whitehouse Station, NJ (US); John Dinunzi, Easton, PA (US)

(73) Assignee: Safe-Crossings, L.L.C., Newark, NJ (US)

( * ) Notice: Subject to any disclaimer, the term of this patent is extended or adjusted under 35 U.S.C. 154(b) by 846 days.

(21) Appl. No.: 12/070,691

(22) Filed: Feb. 21, 2008

(51) Int. Cl.
*G08G 1/095* (2006.01)

(52) U.S. Cl. ..... 340/908; 340/908.1; 340/931; 340/932.1

(58) Field of Classification Search ..... 340/908, 340/908.1, 931, 932.1
See application file for complete search history.

(56) References Cited

U.S. PATENT DOCUMENTS 3,886,519 A * 5/1975 Hovland ..... 340/908.1
4,593,265 A * 6/1986 McKenney ..... 340/908.1
4,706,087 A * 11/1987 Holznagel ..... 340/908
4,992,788 A * 2/1991 Arndt ..... 340/908
5,097,790 A * 3/1992 Massey ..... 116/63 P
5,122,797 A * 6/1992 Wanasz ..... 340/908.1
5,475,386 A * 12/1995 Luoma ..... 340/908
6,836,222 B1 * 12/2004 Carini ..... 340/908.1
7,341,397 B2 * 3/2008 Murphy ..... 404/6
2004/0251698 A1 * 12/2004 Welch et al. ..... 293/133
2006/0055558 A1 * 3/2006 Rohl ..... 340/907
2007/0012534 A1 * 1/2007 Murphy ..... 188/377
2009/0166998 A1 * 7/2009 Groeneweg ..... 280/408

* cited by examiner

*Primary Examiner* — Jerry Redman
(74) *Attorney, Agent, or Firm* — Joanne M. Martin

(57) ABSTRACT

A manually operated traffic barrier gate which may economically installed and maintained, and easily operated by a single individual during emergency or other critical situations. One embodiment comprises a permanently mounted barrier gate movable from a retracted, upright position to lowered position extended to bridge a preselected traffic path, wherein the gate is counterbalanced to stay in the upright position until deployed, and to be balanced to stay in the deployed state when extended. The barrier gate are operable by one person and includes locking devices to maintain their stored upright or deployed lowered position. A further embodiment of the present invention provides a dual mobile gate which may be towed singly or in a chain (dual gate one behind the other), in a retracted length to the desired location, and thereafter be disconnected from the towing vehicle and left at the site to be deployed in an extended manner or retracted and moved as needed.

9 Claims, 4 Drawing Sheets

BARRIER GATE

FIELD OF THE INVENTION

The present invention relates to manually deployable gates, in particular, to manually deployable traffic barrier including emergency and portable gate applications.

BACKGROUND OF THE INVENTION

There are many occurrences where foot and vehicle traffic needs to be selectively and rapidly changed to permit passage in one situation, and to prevent passage in other situations. The changes in situations may result from severe weather, disaster, public events, etc., in which when, or even where the change in traffic is hard or impossible to anticipate or control when needed.

Furthermore, the typical gate systems are complex, too cumbersome for 1-person operation, or simply not placed where needed, to effectively control the traffic situation where needed. Moreover, the corresponding costs further reduce or interfere with the usage of gates, resulting in an under- or non-controlled traffic flow.

SUMMARY OF THE INVENTION

The apparatus according to the present invention comprises a manually operated traffic barrier gate which may economically installed in many locations and economically maintained and easily operated by a single individual during emergency or other critical situations. One embodiment comprises a permanently mounted barrier gate movable from a retracted, upright position to lowered position extended to bridge a preselected traffic path, wherein the gate is counterbalanced to stay in the upright position until deployed, and to be balanced to stay in the deployed state when extended. The barrier gate are operable by one person and includes locking devices to maintain their stored upright or deployed lowered position.

A further embodiment of the present invention provides a mobile gate which may be towed singly or in a chain (one behind the other), in a retracted length, to the desired location, and thereafter be disconnected from the towing vehicle and left at the site to be deployed in an extended manner or retracted and moved as needed. The embodiment may also be deployed and operated by a single person.

A still further embodiment comprises a multiple mobile gate having a platform on an wheel axle and a towing tongue, and typically two gates that are retracted and extend away from the towing tongue when towed, and selectively rotated about the axis of their own upright which is mounted to the platform. The mobile barrier gates may be selectively extended and moved along an arc to where deployment is desired, and selectively retracted and/or raised into an upright position as desired. Further embodiments provide for the towing of subsequent mobile gates on prior mobile gates to permit a train of gates to be towed to the needed positions.

BRIEF DESCRIPTION OF THE DRAWING

These and further features of the present invention will be better understood by reading the following Detailed Description together with the Drawing, wherein.

DETAILED DESCRIPTION OF THE PRESENT INVENTION

Figure 1:
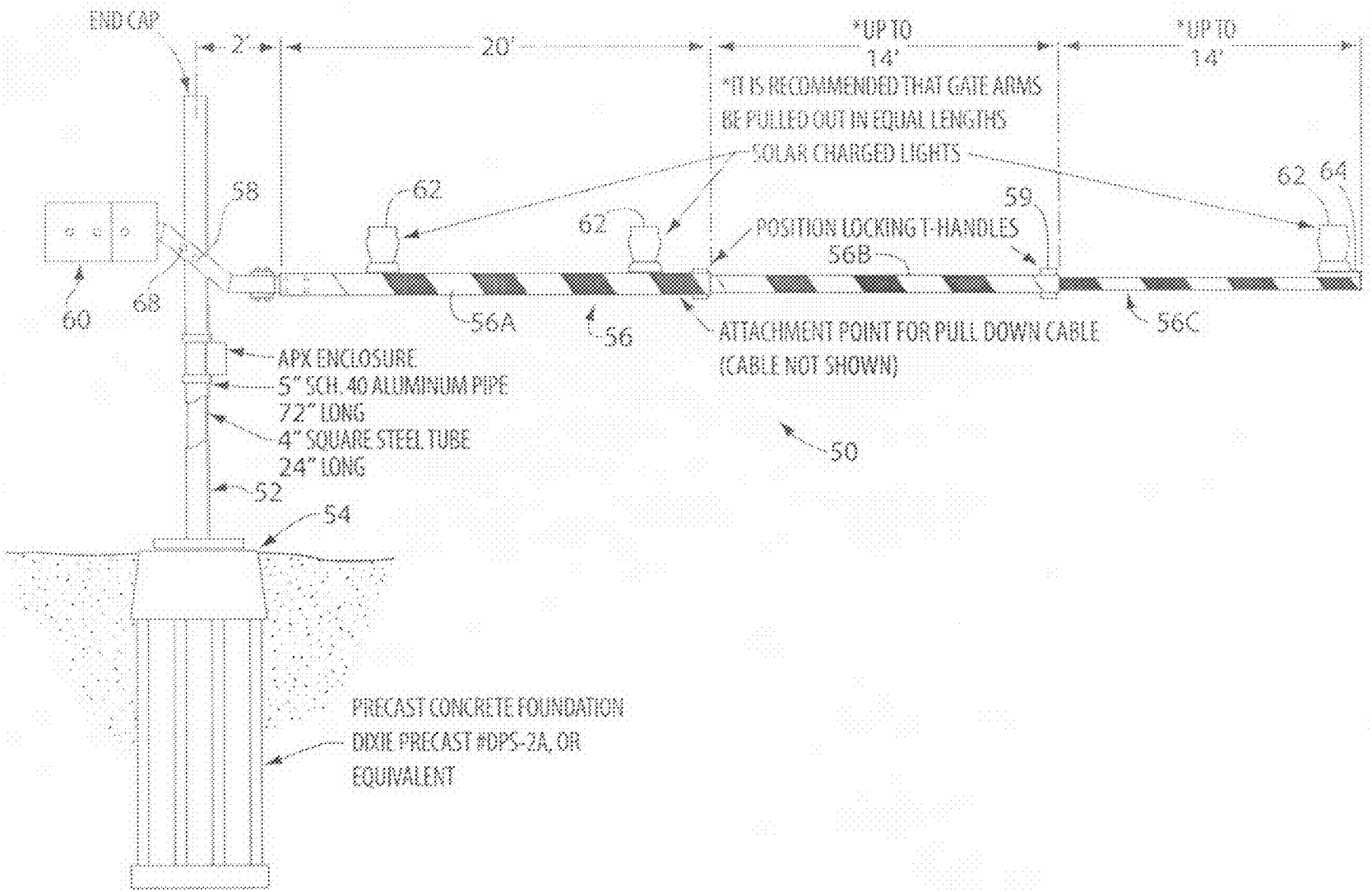
FIG. 1 is a vertical plan view of and exemplary embodiment of an installed gate according to the present invention having the gate extended in a horizontal deployment.

An embodiment 50 of the installed gate is shown in FIG. 1, comprising an upright 52 secured to a foundation 54 and retaining an extendable gate 56 at a pivot 58. The gate 56 further includes a counterbalance 60 disposed on the side of the pivot 58 opposite to the extendable portion of the gate 56, shown having 3 sections 56A, 56B and 56C corresponding to outer, middle and inner gate sections. Section extension stops and slide bearings (not shown) are fabricated to conform to the inner lower portion of the end of the gate member 56A (or 56B) distal from the pivot 58 and are mounted thereon, and complementary stops and slides are fabricated to conform to the inner lower portion of the end of the gate members 56B (or 56C) proximal to the pivot and are mounted thereon. The stops and slides mounted on gate elements 56A and 56B (or 56B and 56C) have sufficient thickness to allow the inner gate member 56B (or 56C) to slide thereon, yet sufficiently thick to engage each other when in contact to inhibit further extension of the inner gate element 56B (or 56C) out of the corresponding surrounding gate element 56A (or 56B). When the inner gate portion, e.g. 56B, is shorter than the outer portion, e.g. 56A, a retraction stop (not shown) is inserted near the end of the outer gate portion 56A proximal to the pivot at a distance to prevent the next inner gate portion 56B from sliding off the corresponding slide and stop element at the distal end of the outer gate portion. Also shown are warning lights 62 disposed on at least 2 sections of the gate, e.g. 56A and 56C. The warning light typically comprises a steady or flashing light powered by a solar rechargeable battery, and optionally includes automatic low-light sensing and/or position sensing (gate up/down) switch (e.g. by mercury tilt switch) to accordingly turn on the warning lights 60. Moreover, the warning lights connected to the inner gate sections 56B and/or 56C, are mounted on a bracket, e.g. 64 which extends out from the gate section over the outer gate section 56A to retain the respective warning light.

In one embodiment, the outer gate section 56A comprises a 20 foot long channel 0.125 inches thick, having a outer dimension of 5.333×3.063 inches, the middle gate section 56B having a length of 18 feet and an outer dimension of 4.597×1.750 inches with a wall thickness of 0.083 inches, and the inner section having a similar wall thickness, a length of 17 feet and outer dimensions of 4.000×1.000 inches. Additionally, the gate section 56A, 56B and 56C further include reflective markings, such as red and white reflective stripes, typically Type III high intensity engineering grade markings compliant with existing FHWA standards.

Figure 2:
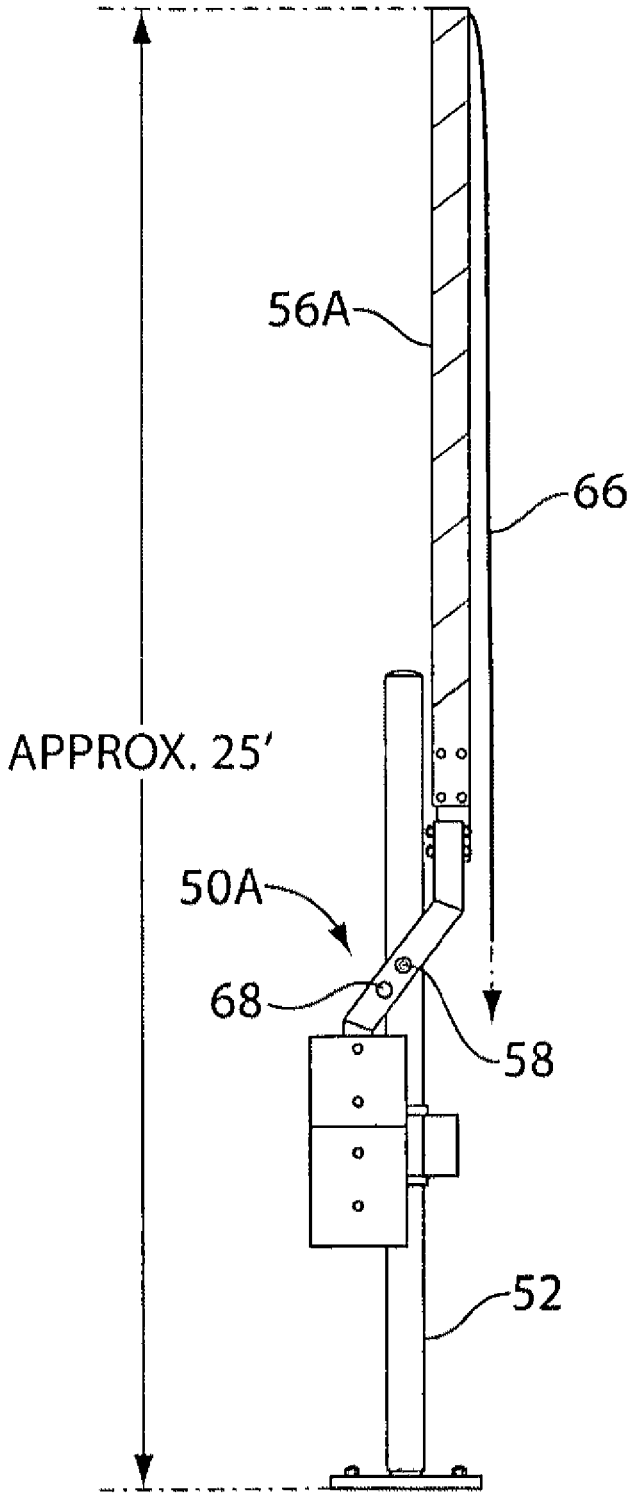
FIG. 2 is a vertical plan view of the embodiment of FIG. 1, showing the installed gate retracted and in the vertical position.

A raised, retracted gate 50A is shown in FIG. 2 (without lights 62), wherein the pivot 58 on the upright is approximately 3 feet above ground level. A pull-down cable 66 is attached to the end distal from the pivot 58. A gate lock may be provided to secure the gate 50A in an upright position. Further movement past vertical is limited by, stop 68 retained in an arm portion, typically between the pivot 58 and the weight 60", acting against the upright 52. In the upright and retracted position shown in FIG. 2, the weight 60 more than counterbalances the retracted gate arm 56, but preferably by a modest amount, requiring approximately 5-10 pounds of downward force on the pull-down cable to move the gate arm 56 into the horizontal position of FIG. 1.

In operation, the barrier gate 50A is pulled down by the pull-down cable 66, and the inner gate arm section 56C is horizontally extended which urges the middle (or any further inner) sections to be extended until the inner gate slides and stops engage and limit further extension, up to a maximum length of the three sections 56A, 56B and 56C of exemplary FIG. 1, of 50 feet. Further downward movement of the extended gate 56 is limited by a stop between a gate arm section and the upright, such as stop 68. The gate sections 54B and 56C are locked into a fixed horizontal position by locking handles 59 inserted into apertures (not shown) in the respective gate sections. Having extended the gate 56, the weight no longer provides sufficient force to raise the gate 56, and the extended gate 56 remains deployed in a horizontal position. An optional support (not shown) may be disposed under the gate 56 distal to the pivot.

Figure 3:
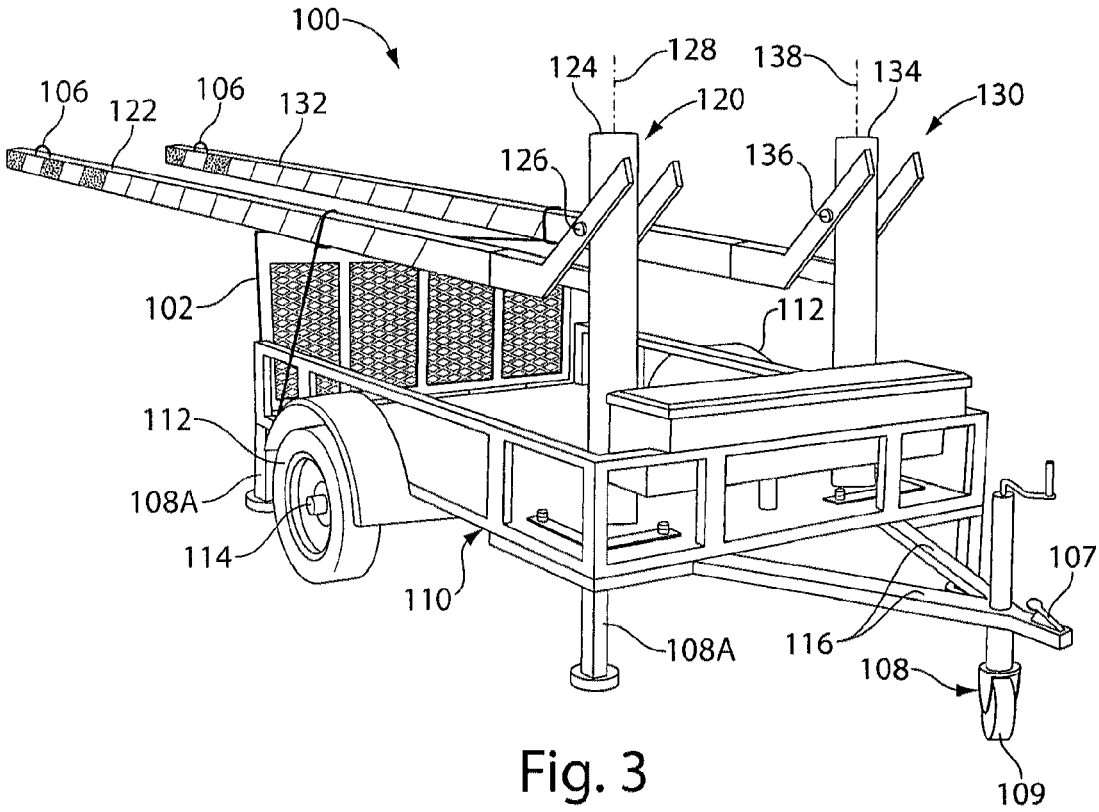
FIG. 3 is a perspective view of an exemplary mobile dual gate embodiment according to the present invention.
Figure 4:
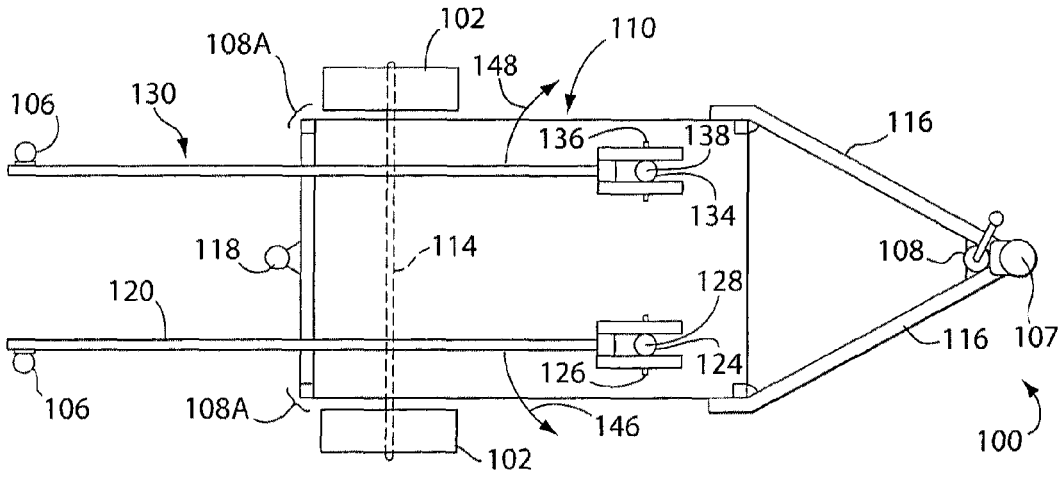
FIG. 4 is a plan view of the mobile dual gate embodiment of FIG. 3.
Figure 5:
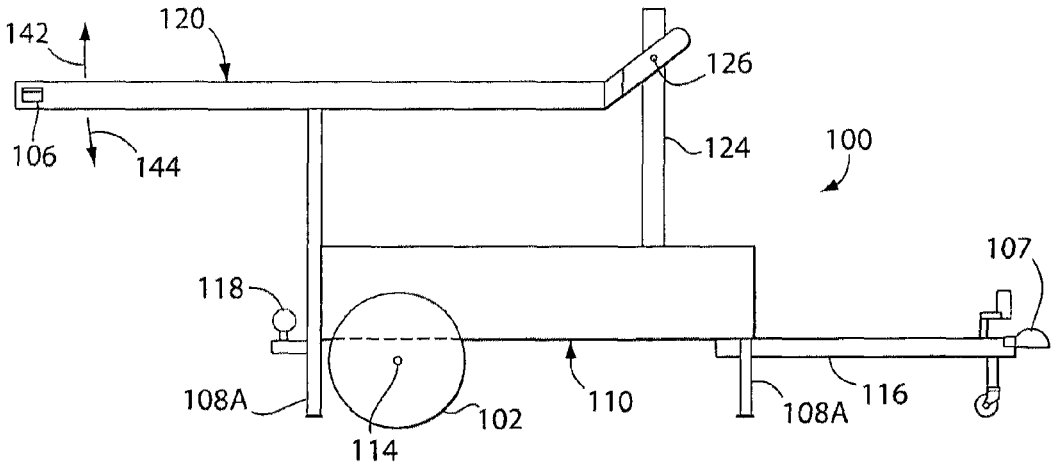
FIG. 5 is a vertical elevation view of the mobile dual gate embodiment of FIG. 3

A perspective view 100 of an exemplary mobile gate according to an alternate embodiment of the present invention is shown in FIG. 3, along with plan and side elevation views shown in FIGS. 4 and 5. The mobile gate comprises a trailer 110 of user selectable dimensions, e.g. 8 feet long by 5 feet wide, having two gates 120 and 130 mounted thereon, the respective gate arms 122 and 132 shown in FIG. 3 in the retracted position and resting on a movable trailer 110 rear panel 102. The gate arms correspond in construction and function to the gate arm 56 shown and discussed, above. The gate arms 122 and 132 connect to and pivot on shortened uprights 124 and 134 at pivots 126 and 136, respectively, up and down, 142 and 144. The uprights are disposed forward of wheel axle 114 and behind trailer hitch 107 to place the gate arm and upright load on the trailer in an advantageous position to facilitate towing at desired highway speeds without lateral swaying or other unwanted towing motions. Furthermore, the uprights 124 and 134 pivot 146 and 148 about their own axes 128 and 138, respectively, to allow the gate arms 122 and 132 to pivot from a stowed position approximately over the wheel 112 axle 114 which supports the trailer 110, to a deployed position within a range of at least 1800 from the stowed position, including a disposition where the gate arms would be substantially in-line to effect the desired access control over a range of distance up to twice the distance of two gates 56 of the embodiment of FIG. 1 (plus the spacing between the gate uprights 124, 134).

The trailer 110 further includes support arms 116 connected to a trailer hitch 107 adapted to be connected to a corresponding hitch ball or other complementary device on a towing vehicle (not shown). An optional hitch ball (or towing device) 118, shown in FIGS. 4 and 5, is disposed on the rear of the trailer 110 which allows subsequent mobile gates, e.g. 100, to be towed one after the other. An adjustable jack support 108 (shown with optional pivotable wheel 109) is provided to support the arms 116 near the hitch 107, and alternately, 4 separate retractable lift jacks 108A are shown disposed on the 4 corners of the exemplary trailer 110. Trailer towing lights 106, which connect to the illumination and brake light circuitry of the towing vehicle to provide desired vehicle lighting and alternately gate lights are attached which are similar to lights 62 of the above described gate 50 of FIG. 1.

The structures and features provided by one embodiment may be applied to the other, e.g. the addition of the weights 60 to the gates 120 and 130 of FIG. 3, are within the scope of the present invention. Further modifications and substitutions of these and further embodiments as made by one of ordinary skill in the art according to the teaching of the present invention are within the scope of the present invention, which is not to be limited, except by the claims which follow.

What is claimed is:

1. A mobile gate, comprising:

a platform having a plurality of members extending therefrom each along a corresponding vertical axis, and a plurality of wheels disposed to rotate about a common axis;

two substantially identical telescoping traffic directing gates mounted on said platform, each having an extended and a retracted position and each pivotable about said vertical axis of a corresponding one of said plurality of members; and a towing tongue connected to said platform and configured to be received by a towing vehicle, wherein each said gate and each corresponding said member is disposed on said platform to impose an unbalanced downward weight on said towing vehicle when said gate is in said retracted position.

2. The gate of claim 1, wherein at least one gate comprises a plurality of telescoping sections including an inner telescoping section being disposed to extend from an outer section successively and retaining a portion of said inner telescoping section within said outer telescoping section, said gate further including locking pins disposed to transverse through said portion of said inner telescoping section and the surrounding outer telescoping section to fix the relative positions thereof.

3. The mobile gate of claim 1, wherein in said gate includes a pivot to allow a pivotable motion from horizontal to vertical.

4. The mobile gate of claim 1, wherein said two gates are disposed to be selectively movable to parallel disposition in a towing mode and movable to a non-parallel deployed position.

5. The mobile gate of claim 1, further including a tongue support, which together with said plurality of wheels, defines a stable plane of said platform.

6. The mobile gate of claim 1, further including a plurality of selectively extendable trailer stabilizers connected to said platform and laterally disposed to relieve weight load from wheels.

7. The mobile gate of claim 1, wherein said gate includes an end distal from said platform and further including a tail light disposed thereon being connected to a towing vehicle electrical system.

8. The mobile gate of claim 1, further including a rear trailer hitch mounted on said platform distal from said towing tongue and being disposed to receive a subsequent towing tongue from a subsequent mobile gate.

9. The mobile gate of claim 8, further including a gate support disposed to permit rear-extending gates to be lifted upward from the horizontal to avoid interaction with said subsequent mobile gate.

* * * * *